US005984315A

United States Patent [19]

Burkhardt et al.

[11] Patent Number: 5,984,315

[45] Date of Patent: Nov. 16, 1999

[54] RECLAMATION SYSTEM FOR A HYDRAULIC PUMP SYSTEM

[75] Inventors: Michele Lee Burkhardt, Hilliard; Jack W. Wilcox, Columbus, both of Ohio

[73] Assignee: Denison Hydraulics Inc., Marysville, Ohio

[21] Appl. No.: 08/727,940

[22] Filed: Oct. 9, 1996

[51] Int. Cl.[6] ..... F16J 15/54

[52] U.S. Cl. ..... 277/500; 277/552; 277/928

[58] Field of Search ..... 277/500, 552, 277/928; 415/168.1, 168.2

[56] References Cited

U.S. PATENT DOCUMENTS

| | | | |
|---|---|---|---|
| 3,722,624 | 3/1973 | Buckland | 277/15 |
| 4,136,886 | 1/1979 | Sjoholm et al. | 277/15 |
| 4,504,056 | 3/1985 | Devine | 277/12 |
| 4,621,981 | 11/1986 | Lorett | 415/168.2 |
| 5,173,019 | 12/1992 | Sdano | 415/168.2 |
| 5,516,119 | 5/1996 | Trackwell et al. | 277/15 |

*Primary Examiner*—Anthony Knight
*Assistant Examiner*—John L. Beres
*Attorney, Agent, or Firm*—Thomas S. Baker, Jr.

[57] ABSTRACT

A hydraulic pump system is provided with a leakage fluid reclamation sub-system having connected eductor and fluid line elements that function to return hydraulic fluid leaked from around the system drive shaft to the reservoir of the hydraulic fluid pump.

3 Claims, 2 Drawing Sheets

RECLAMATION SYSTEM FOR A HYDRAULIC PUMP SYSTEM

CROSS-REFERENCES

None.

FIELD OF THE INVENTION

This invention relates generally to hydraulic pumps, and particularly concerns a servo-controlled hydraulic pump system having an eductor element combined with its servo-control loop in a novel manner that functions to reclaim hydraulic fluid otherwise undesireably leaked from within the pump.

BACKGROUND OF THE INVENTION

It is generally known that in certain hydraulic pump installations, particularly when the pump drive shaft is oriented vertically and positioned to project above the pump housing, hydraulic fluid may be caused to leak from within the pump housing and at the pump mounting over periods of prolonged pump operation. In many cases the quantity of leaked hydraulic fluid is large and the external area of accumulated fluid leakage is substantial. Attempts to solve the problem by designing and providing totally leak-free pump shaft seals have not been entirely successful.

We have discovered that the shortcoming of known shaft seals in such hydraulic pump installations can be overcome by utilizing an approach wherein fluid leaked past an installed shaft seal is recovered and reused within the hydraulic pump system servo-control loop rather than being allowed to escape from within the pump housing in the zone of the pump mounting.

Also, other objects and advantages of the novel reclamation system of the present invention will become apparent from a careful consideration of the descriptions, drawings, and claims which follow.

SUMMARY OF THE INVENTION

The present invention, as applied to a known variable-volume type of hydraulic pump, is basically comprised of the system servoloop pump, a miniature eductor element, an additional and spacedapart shaft seal element, and fluid lines functionally connecting an auxiliary pump outlet to the eductor element pressurized fluid inlet, functionally connecting the zone intermediate the shaft seals to the eductor element leakage fluid inlet, and functionally connecting the eductor element fluid outlet to the pump system hydraulic fluid sump or reservoir. Additionally, a suitable check valve may be advantageously provided in the fluid line connecting the zone intermediate the shaft seals to the eductor element leakage fluid inlet.

Additional details regarding the system construction are provided in the drawings and detailed description.

DETAILED DESCRIPTION

Figure 1:
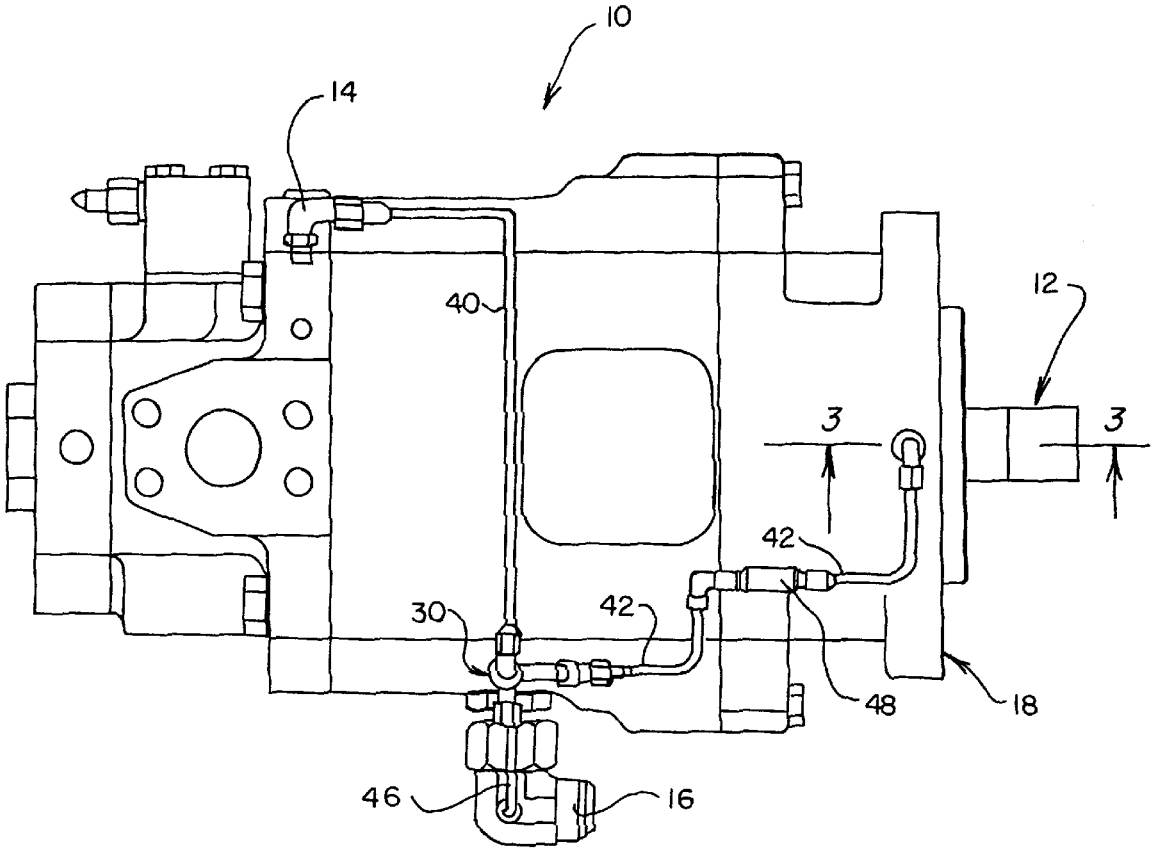
FIG. 1 is side elevation view of a representative servo-controlled hydraulic pump system but having a preferred embodiment of the leakage reclamation sub-system of the present invention incorporated therein.
Figure 2:
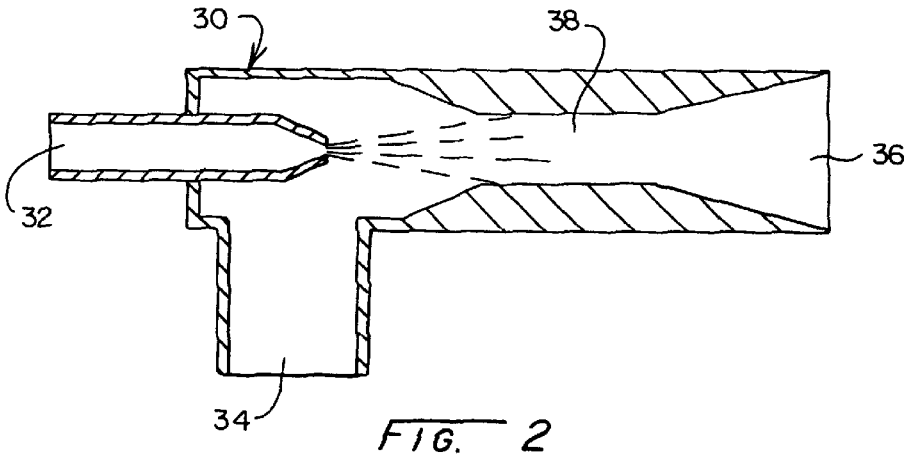
FIG. 2 is a schematic sectioned view of the miniature eductor element incorporated in the leakage reclamation sub-system of the FIG. 1 hydraulic pump system.

In FIG. 1 of the drawings we illustrate a representative hydraulic pump system 10 having a preferred embodiment of the leakage reclamation sub-system of the present invention incorporated therein. Pump system 10 includes a drive shaft element 12 which typically is connected to an electric motor or other motive power source, a pressurized hydraulic fluid outlet port 14, an auxiliary pump which may be a servo hydraulic fluid pump (not shown), and a case or housing drain port 16 that communicates with a conventional hydraulic fluid reservoir. It should be noted that the auxiliary pump may be a supercharge pump, a separately attached pump or any device providing a source of pressure fluid. Hydraulic pump system 10 often is a variable volume type of hydraulic pump system in which piston stroke displacements are varied in response to control inputs received from the included pump system servo control loop.

Figure 3:
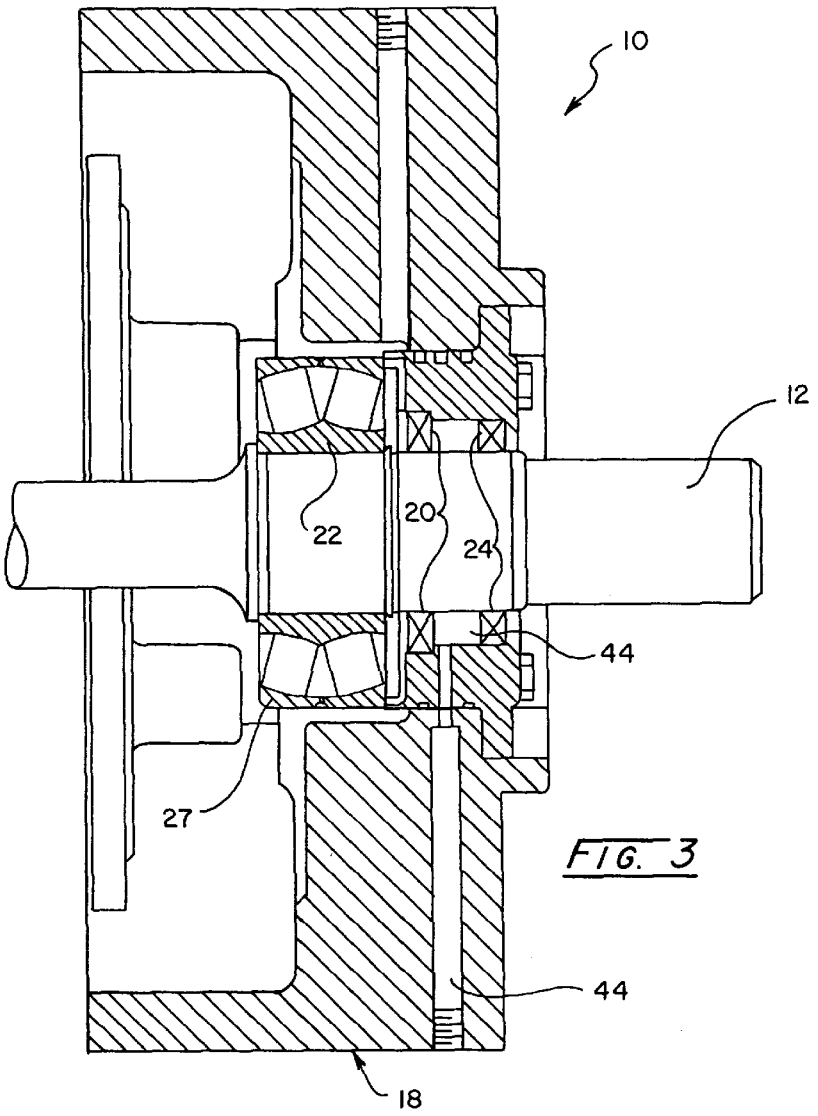
FIG. 3 is a sectioned illustration taken at line 3—3 of FIG. 1.

Referring to FIG. 3, system 10 also typically includes an integral end mount 18, a conventional, primary or lip-type oil seal element 20 positioned in the end mount in surrounding relation to drive shaft 12 and in proximity to the spherical roller bearing assembly 22 provided for the support of drive shaft 12, and a conventional, secondary or dry-type air seal element 24, also surrounding drive shaft 12 but spaced apart from oil seal element 20. In instances wherein the conventional hydraulic pump system is mounted vertically with the air seal positioned uppermost, and even though the conventional oil and air seal dual seal arrangement may be utilized, substantial hydraulic fluid leakage may be experienced over prolonged periods of pump system operation. Accordingly, and to remedy such problem, we provide additional components in system 10 to effectively reclaim leakage fluid from between seal elements 20 and 24 prior to its escape to the system ambient environment.

The principal components of the leakage reclamation sub-system include: a "miniature" conventional eductor element 30 having an eductor pressurized fluid inlet port 32, an eductor leakage fluid inlet port 34, and an eductor outlet port 36 in addition to an eductor venturi throat 38; a fluid line 40 connected to pressurized hydraulic fluid outlet port 14 of a servo-control loop which acts as an auxiliary pump fluid source and to eductor inlet port 32; a fluid line 42 connecting eductor leakage fluid inlet port 34 to leakage fluid collection zone 44 situated in end mount 18 essentially between spaced-apart oil and air seals elements 20 and 24; and a fluid line 46 connecting eductor outlet 36 to case drain 16 in fluid flow relation. Also, we find it advantageous to include a check valve element 48 in the leakage reclamation sub-system in fluid line 42. It should be noted that when incorporating the leakage reclamation sub-system into hydraulic pump system 10, that, in addition to creating the vacuum leakage collection zone 44 in end mount 18, we prefer that air seal 24 be a lip-type seal.

Figure 4:
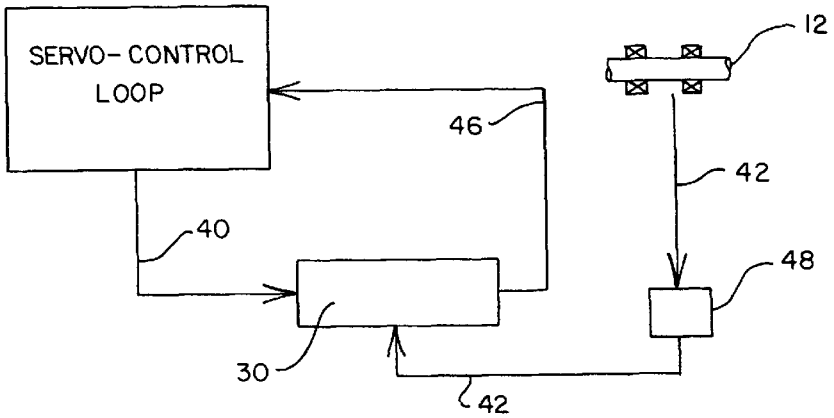
FIG. 4 is a schematic illustration of the functional relationship of the leakage reclamation sub-system components incorporated in the FIG. 1 hydraulic pump system.

A schematic diagram of the leakage fluid reclamation sub-system incorporated into hydraulic pump system 10 is provided in FIG. 4. In practice, one actual embodiment of the sub-system utilizes a fluid flow of approximately 0.5 gallons per minute from a servo-loop fluid pump at a pressure in the range of from approximately 400 pounds per square inch to approximately 500 pounds per square inch. The incorporated "mini-eductor" functions well so long as the pump system case drain pressure is below approximately 40 pounds per square inch. If the case drain pressure exceeds that value, eductor element 30 no longer develops the desired vacuum condition in collection zone 44. Check valve 48 preferably has an O-ring seat and is provided to prevent any back flow of leakage fluid during system shut-down and during periods of excessively high case drain pressure.

Various changes may be made in the shapes, sizes, and materials of construction of the disclosed apparatus without departing from the scope or intent of the claims which follow.

We claim as our invention:

1. In a variable displacement hydraulic pump system having a drive shaft mounted in a shaft bearing, the combination comprising:

variable displacement pump means connected to the pump system drive shaft;

servo control means regulating the displacement of said variable displacement pump means;

auxiliary pump means having an outlet providing hydraulic fluid from a hydraulic fluid reservoir at elevated pressures for said servo control means and for leakage hydraulic fluid reclamation;

primary fluid seal means contacting the pump system drive shaft in fluid-sealing relation adjacent said shaft bearing;

secondary fluid seal means contacting the pump system drive shaft in fluid-sealing relation spaced apart from and outboard of said primary fluid seal means;

a leakage hydraulic fluid collection zone positioned intermediate said primary and secondary fluid seal means;

eductor means having a pressurized inlet port, a leakage fluid inlet port, and a fluid outlet port;

first fluid line means connected to said eductor means pressurized fluid inlet port and to said auxiliary pump means outlet in fluid flow relation;

second fluid line means connected to said eductor means leakage fluid inlet port and to said leakage hydraulic fluid collection zone in fluid flow relation; and third fluid line means connected to said eductor means fluid outlet port and to said auxiliary pump means hydraulic fluid reservoir in fluid flow relation.

2. The invention defined by claim 1 and further comprising check valve means incorporated in said second fluid line means, said check valve means preventing the back flow of hydraulic fluid from said eductor means to said leakage fluid collection zone.

3. The invention defined by claim 1 wherein said auxiliary pump means is a servo-loop pump.

* * * * *